US007475771B2

(12) United States Patent
Schmetzer

(10) Patent No.: US 7,475,771 B2
(45) Date of Patent: Jan. 13, 2009

(54) STACKER

(75) Inventor: Dietmar Schmetzer, Gschlachtenbretzingen (DE)

(73) Assignee: Optima Filling and Packaging Machines GmbH, Schwabisch Hall (DE)

( * ) Notice: Subject to any disclaimer, the term of this patent is extended or adjusted under 35 U.S.C. 154(b) by 0 days.

(21) Appl. No.: 10/575,151

(22) PCT Filed: Sep. 9, 2004

(86) PCT No.: PCT/EP2004/010040

§ 371 (c)(1),
(2), (4) Date: Nov. 30, 2006

(87) PCT Pub. No.: WO2005/040020

PCT Pub. Date: May 6, 2005

(65) Prior Publication Data

US 2007/0108218 A1 May 17, 2007

(30) Foreign Application Priority Data

Oct. 9, 2003 (DE) ..... 103 48 233

(51) Int. Cl.
*B65G 47/04* (2006.01)

(52) U.S. Cl. ..... 198/803.13; 198/803.1

(58) Field of Classification Search ..... 198/867.1, 198/803.13, 803.1
See application file for complete search history.

(56) References Cited

U.S. PATENT DOCUMENTS 3,276,569 A * 10/1966 Seedorf ..... 198/803.13
4,223,779 A * 9/1980 Hopkins ..... 198/426
4,399,905 A 8/1983 Lance et al.
4,768,642 A 9/1988 Hunter
4,927,322 A 5/1990 Schweizer et al.
5,127,209 A * 7/1992 Hunter ..... 198/419.3
5,474,168 A 12/1995 Leslie et al.
5,897,292 A 4/1999 Gerwe et al.
5,960,927 A 10/1999 Bahr
6,021,886 A 2/2000 Remericq
6,298,980 B1 * 10/2001 Totani ..... 198/803.1
2002/0088687 A1 7/2002 Hofmann et al.

FOREIGN PATENT DOCUMENTS

EP 0 700 832 3/1996
EP 1 148 014 A2 4/2001
JP 2028468 1/1990

* cited by examiner

*Primary Examiner*—James R Bidwell
(74) *Attorney, Agent, or Firm*—Boyle Fredrickson, S.C.

(57) ABSTRACT

A device for stacking flat, deformable, items contains a transfer device that accommodates individual items conveyed to it in receptacles and conveys them to a serializing device. At that transfer device, a row of compartments, into which the items are inserted, is conveyed transversely to the direction along which items' arrive. During insertion, items receive a velocity component in the compartments' direction of motion, while being brought to a standstill along their original direction of motion by one or the other of their flat sides coming into contact with a compartment wall, or an item that had been previously inserted into the compartment, in order that the compressive forces, and thus the deforming forces, exerted on the items will be slight.

17 Claims, 2 Drawing Sheets

STACKER

Figure 1:
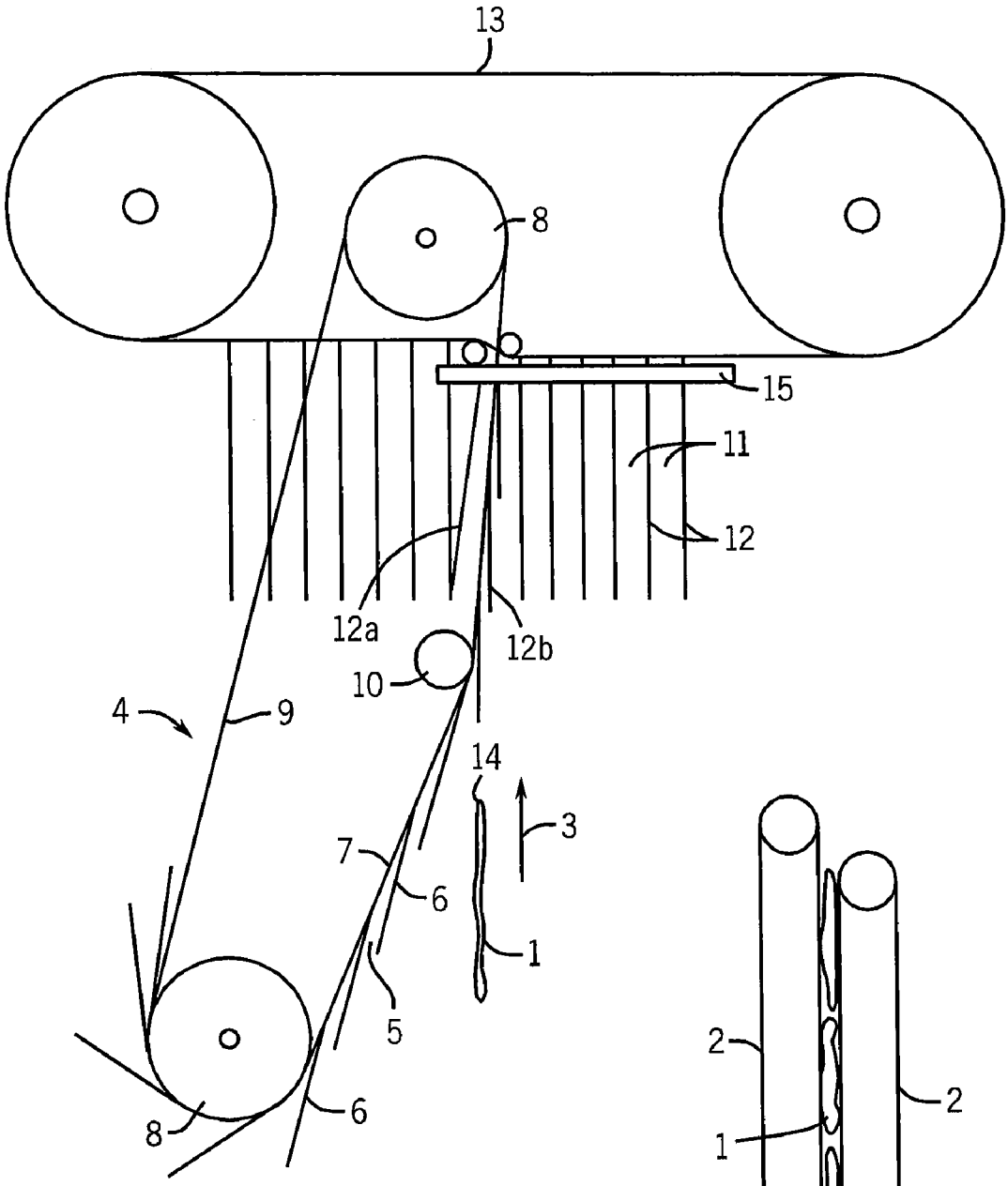

The invention is based on a device that may be utilized for stacking flat, deformable, items. An example thereof is diapers, which are deformable due to their composition. Such products are manufactured on machines and ejected therefrom such that they are conveyed along their long axes. Products that are flat, but have no long axis, are conveyed parallel to their flat sides, which shall be interpreted as also meaning "conveyed along their long axis."

Products conveyed along their long axes must be stacked such that their flat sides face one another and are in contact with one another. It might also be necessary to arrange them such that their flat sides face one another, but are separated by partitions. Their transport rate will have to be reduced if they are to make the transition from being conveyed along their long axes to being stacked. Since they are deformable, abrupt decelerations might cause them to become crumpled such that they will lose their flat shapes and can no longer be stacked.

A stacker of that type, wherein items consecutively conveyed to it are decelerated within a transfer device and subsequently laterally transported, is known (cf. EP 11 48 014). In order to decelerate the items, the transfer device contains individual receptacles, each of which has a pair of sidewalls that are arranged at a fixed angle of around 30°. The items impact a tilted sidewall, over which their leading edge glides until they are brought to a standstill.

A device that has a guide situated between a vertically oriented, permanently installed, feeder device for supplying products and a horizontally translated row of compartments that guides products between the feeder device and the compartments, and into their respective, assigned compartments, has also been proposed (cf. unpublished patent application 102 28 061).

The invention is based on the problem of devising a general-purpose device for stacking flat items that will improve throughput, even of deformable products, while retaining the benefits of known devices.

In order to solve that problem, the invention proposes a device having those features stated under claim 1. Elaborations on the invention are covered by subclaims.

The transfer device accepts individual products consecutively supplied to it. That acceptance might occur some distance ahead of the serializing device, in which case, the transfer device will transfer products to the serializing device, where they will be reoriented with their flat sides parallel and facing one another. While in that parallel orientation, products may be arranged in the compartments of the row of compartments. If there is a gap between the location where products are accepted and the transfer device, a certain stretch, within which products may be decelerated, will be available.

It is therefore proposed that, in elaborating on the invention, the transfer device be configured such that it will decelerate products along their long axes, from their transport rate to a standstill, between the location where they are accepted and the location where they are transferred to the serializing device. That gradual deceleration will reduce, or eliminate, hazards that individual products might be deformed, in particular, be crumpled.

Products might be decelerated by, for example, their flat sides contacting an abutment moving at low speed, in which case, decelerating forces will be spread over a large portion of their flat sides, rather than concentrated at their leading edges, which could cause crumpling.

In further elaborating on the invention, it may be provided that the transfer device is configured such that is gives products a velocity component along the row of compartments' transport direction, which will also provide for a more gradual transition between the two directions of motion in order that, in this case as well, hazards of undesired deformations occurring will be reduced, or eliminated.

In further elaborating on the invention, in order to accommodate individual products, the transfer device might have receptacles that accommodate a single product each, where those receptacles are preferably transported at a constant rate that is less than the rate at which products are transported. In particular, according to the invention, it may be provided that the receptacles change their shape, for example, spread apart and subsequently draw together, ahead of and/or following the location where products are accepted, which will ease insertion of products. Simultaneously, that drawing together subsequent to acceptance of a product will allow faster decelerations of products, in some cases, by forces acting on both sides thereof.

For example, every receptacle might have a pair of parallel sidewalls oriented at an acute angle to one another, each of which is common to a pair of adjacent receptacles, which will allow moving the receptacles closer to one another in order to allow processing products to be processed at shorter intervals along their transport direction. That facility will be further eased if their sidewalls may be spread apart somewhat in order to increase the distance between them immediately before products are inserted into them. In order to accomplish that, it will be sufficient to tilt their trailing sidewall to the rear. Tilting their trailing sidewall to the rear will force the product contained therein up against their trailing sidewall, which might decelerate the product.

A flattened section, for example, a sort of abutment, might also be provided in the vicinity of the apex of receptacles in the case of some types of products in order to catch them.

Under an elaboration on the invention, the transfer device's receptacles, or their sidewalls, are preferably attached to a circulating conveyor, for example, a continuous chain or continuous belt. Other means of guiding items around a closed circuit, for example, rails having individual components that are guided along the rails, might also be employed.

For example, their sidewalls might be rigidly attached to the circulating conveyor. In order to open the receptacles, the conveyor might, for example, be conducted over a roller that forms two sections of the conveyor oriented at an obtuse angle with respect to one another. Sidewalls rigidly attached to the conveyor will be tilted upon transiting that roller, or deflection point. Of course, other means, for example, cam followers or similar devices, might also be employed.

In order to neatly orient products, the serializing device might have a stop for product's leading edges. Products will strike that stop at a very low speed, which, if everything is perfectly aligned, will be zero. There will then be no danger that products will be crumpled.

In elaborating on the invention, that stop may, for example, be stationary. Since products are transported along the stacking axis at a rate that is much lower than the rate at which they are transported on the conveyor, there will be no danger that they will be deformed when they strike the stop if they are slid along the stop. It will also be feasible to move the stop in synchronism with the row of compartments, and that is covered by the invention.

The stop might, for example, also be formed from a component of the compartments of the row of compartments.

The compartments of the row of compartments might, for example, be formed between pairs of walls that might be shorter in the vertical direction than the products in order that onward transport of the transfer device's receptacles will not cause conflicts with the compartments' lateral motions relative thereto.

In the case of the moving row of compartments, it may also be provided that the compartment that is currently being loaded by the transfer device will be opened, and subsequently closed, by tilting one of its walls. The trailing walls of the compartments of the row of compartments are preferably tilted for that purpose.

In the case of the moving row of compartments, it may also be provided that the compartments, or the walls forming them, are attached, preferably rigidly attached, to a circulating conveyor. Here again, the circulating conveyor might, for example, be a chain. A slight bend in the chain that will then cause compartment sidewalls to tilt at that point due to the departure of the chain's path from a straight line might be introduced in order to spread the sidewalls apart and open the compartments. That tilting will also compact the contents of compartments to a certain extent when compartments are closed.

When an item is inserted into a compartment, it will be decelerated along the compartment's direction of motion either by the trailing wall of the immediately preceding compartment or by an item that had been inserted into the compartment involved immediately prior to its insertion therein, due to forces acting over much of its leading lateral surface. The resultant of its velocity component along the compartments' direction of motion and the deceleration due to its coming into contact with the compartment wall will cause it to abut against the compartment wall over much of its leading lateral surface, thereby causing decelerations of the of the individual items involved over much of their leading lateral surfaces, as well as over their full longitudinal extents, i.e., over a maximum-possible length of travel.

Insertion of items might, for example, proceed such that items standing on end are inserted horizontally, or approximately horizontally, which will then cause them to also be conveyed horizontally, with one of their flat sides facing forward, in which case, the axes, about which the chain sprockets or belt pulleys over which the circulating conveyor runs, rotate, will be vertically oriented.

The axes of the chain sprockets might also be horizontally oriented and all situated at the same height, in which case, items might be inserted into compartments from above and then later ejected, also horizontally, with one of their flat sides facing forward.

More complex arrangements of the routing of the circulating conveyor, for example, arrangements that involve inserting items that have been laid flat into compartments that are conveyed upward, are also feasible, where occupied compartments could be conveyed around a bend that will provide that they will return to being conveyed horizontally.

Figure 2:
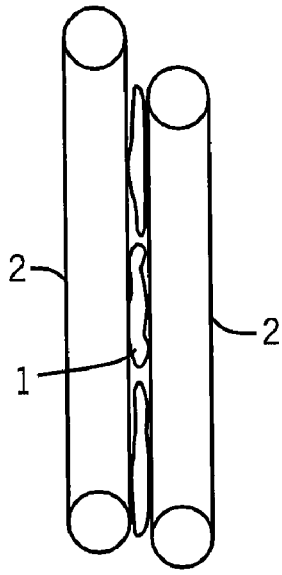
Figure 3:
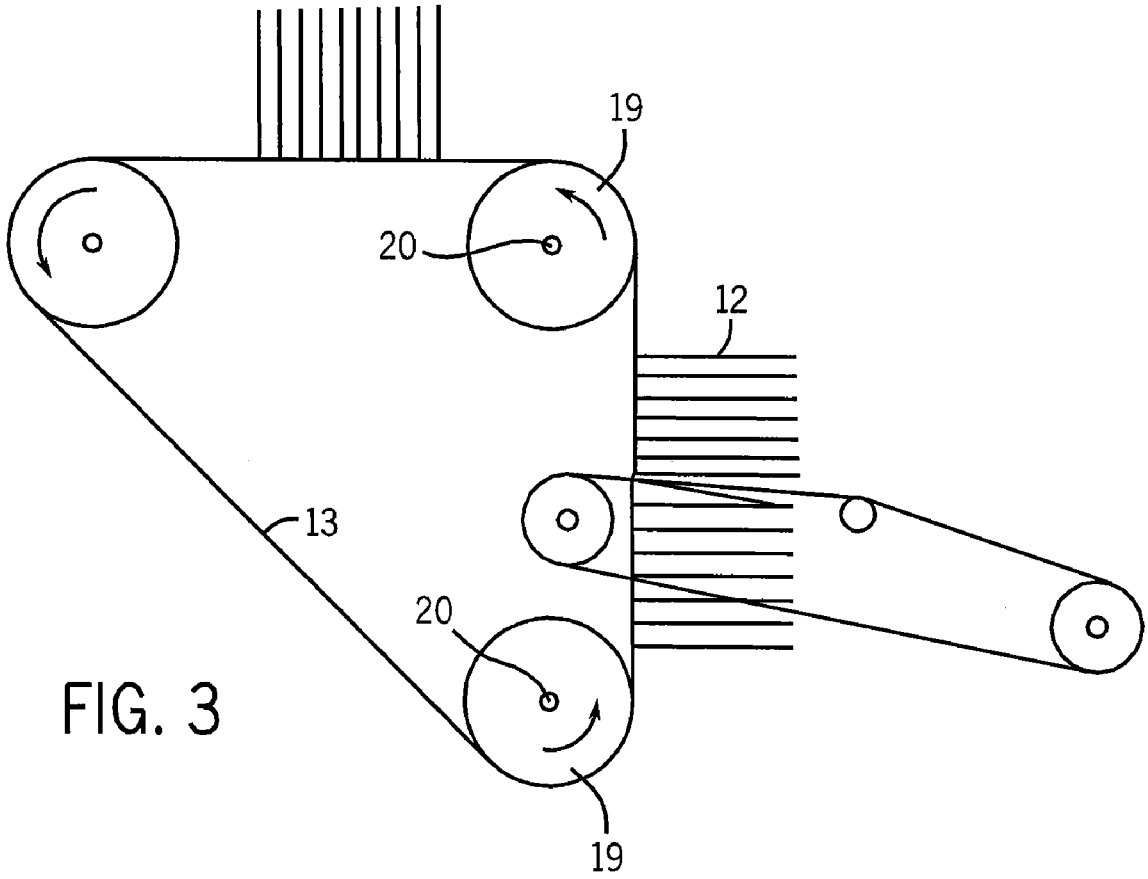

Further features, details, and benefits of the invention will be evident from following description of a preferred embodiment of the invention, the claims and the abstract, whose respective wordings are herewith made integral parts of this description by way of reference thereto, and from the figures, which depict:

FIG. 1 a top view of the device according to the invention;

FIG. 2 a feeder device that supplies products to the transfer device shown in FIG. 1 and FIG. 3 a schematized side view of another device according to the invention.

FIG. 2 shows how individual products 1 are held in place between a pair of conveyor belts 2 and conveyed. The pair of conveyor belts 2 is routed such that the items 1 involved will be held in place between them and conveyed upward. As may be seen from FIG. 2, the individual products 1 are conveyed along a longitudinal direction, with very narrow gaps between them.

Turn now to FIG. 1, where the products 1 are supplied along the direction indicated by the arrow 3. The device proposed by the invention contains a transfer device 4 that has individual receptacles 5. Every receptacle 5 is formed by a pair of sidewalls 6. Every sidewall 6 forms the partition separating a pair of adjacent receptacles 5, i.e., belongs to both receptacles 5. The sidewalls 6 forming the receptacles 5 are rigidly attached to a circulating conveyor 7, for example, a chain. The chain passes over a pair of idler sprockets 8, at least one of which is driven by a drive. The free run 9 of that chain appearing on the left in FIG. 1 is straight, while the free run appearing on the right is routed over an idler sprocket 10 that is offset outward from a straight line tangent to the pair of idler sprockets 8, dividing the conveyor into two sections oriented at an included angle of slightly less than 180° with respect to one another. The orientation of the sidewalls 6 will change at that bend, or deflection point. The location where individual products 1 are inserted into the receptacles 5 is situated in the immediate vicinity of the idler sprocket 10, where the sidewall 6 that has just passed the idler sprocket 10 is no longer parallel to the next sidewall 6 that follows it. At that location, the sidewalls involved are oriented at an acute included angle with respect to one another. The respective trailing sidewalls 6 will be subsequently tilted in order that the two sidewalls will then be mutually parallel. If items 1 are supplied overlapping one another, the rate at which receptacles 5 are conveyed may reduced relative to the rate at which products 1 are conveyed.

The circulating conveyor 7 of the transfer device 4 runs at a constant rate.

Products 1 contained in the receptacles 5 are inserted into the compartments 11 of a row of compartments. The compartments 11 are formed by pairs of parallel walls 12 that are rigidly attached to another circulating conveyor 13. The circulating conveyor has a straight stretch at the location where the products inserted into the compartments. Compartment walls 12 will thus be mutually parallel at that location. The sole compartment wall that will have been tilted rearward in order to open a compartment will be the trailing wall 12*a* immediately adjacent to the compartment currently being loaded by the transfer device. The flat side of the item 1 current being inserted into that compartment will glide along the compartment wall 12*b*, which will gradually decelerate it, without exerting any crumpling forces on the leading edge 14 of the product 1. The next item inserted into the same compartment will then lie flat atop the item 1 previously inserted therein, which will decelerate it along its flat side. There will be no danger that items will be crumpled.

One or more items may be inserted into each compartment 11, depending upon how the latter are configured, which will allow forming stacks that will have their final heights once they have been ejected from the compartments. A stop 15 in the form of a rail arranged above and/or below the compartment walls 12, immediately in front of the circulating conveyor 13, provides for the correct orientation of the products 1 within the compartments 11. The stop 15 may be configured to be stationary. The rate at which products are laterally transported up to the stop 15 is much less than the rate at which products 1 are transported past it, so there is no danger that they will be damaged at this particular location.

The circulating conveyor 13 for transporting the compartment walls 12, and thus the compartments 11, may be continuously driven at a constant rate. The compartment walls 12 may be arranged over the entire length of the conveyor 13.

Once a row of compartments 11 has been loaded with products 1, the stacks formed may be ejected, for example, upward, downward, or forward out of the plane of the drawing, which is a horizontal plane. If a stack of products is formed from products taken from several compartments, that stack may be subsequently compacted.

The bend formed by the sprocket 10 is preferably formed at the location where the compartment walls 12 terminate. In other words, the distance between the bend 10 and the stop 15 should approximately equal the dimensions of the products 1 to be stacked, measured along approximately the same direction.

Within the zone where individual products are arranged for transfer, the direction of transport of the circulating conveyor 7 of the transfer device is angularly offset relative to the compartment walls 12, and thus to the compartments 11, which means that the products 1 will have a lateral velocity component that has been adjusted to suit the rate at which compartments 11 are transported superimposed on them by the time they reach that zone.

In the case of the device proposed here, items may be simultaneously ejected from the ejection sides of several compartments in order that the desired, overall, stacked arrangements will result.

Compartment sidewalls 12 might also be guided such that they remain mutually parallel, rather than tilting relative one another.

The reduction in product spacing along the transport direction (cf. FIG. 2) will allow increasing throughput for a given transport rate. Discontinuously or continuously reducing the rate at which products are transported will protect products.

The tilting motions of the sidewalls 6 at the bend formed by the sprocket 10 will also allow reliably providing that products will be inserted into their respective receptacles 5, even it the products are very closely spaced.

As mentioned earlier, the planes of the drawings of FIGS. 1 and 2 are supposed to be horizontal planes. Items 1 are therefore conveyed to the compartments 11 stood on end, horizontally, along the direction indicated by the arrow 3. The compartments will therefore also be horizontally transported, where one of the flat sides of the items 1 will face forward.

However, a device similar to that shown in FIG. 1 might also be arranged such that the axes, about which the pair of idler sprockets on which the conveyor 13 runs, rotate will be horizontally oriented, in which case, items 1 will, of course, be inserted from above, rather than from below, as is apparently the case in FIG. 1. Items 1 will therefore be conveyed from above, decelerated by the transfer device 4, and inserted into the compartments 11. They may then be ejected along an axis extending into, or out of, the plane of the drawing.

Yet another sort of arrangement is also feasible. For example, the axes of rotation of the pair of idler sprockets, on which the conveyor 13 runs, might be horizontally oriented and arranged one above the other, in which case, the items 1, which are laid flat, will be inserted horizontally and elevated.

Combinations of motions are also feasible (cf. FIG. 3, to which reference shall now be made). FIG. 3 depicts a side view of an arrangement where the circulating conveyor 13 is routed over three idler sprockets 19. The three idler sprockets 19 have mutually parallel, horizontal, axes of rotation 20. The compartment walls 12 arranged on the outside of the conveyor 13 will thus be transported upward along the right-hand side of the drawing when the idler sprockets 19 rotate in the direction indicated, and then be tilted at the bend in the conveyor 13 and subsequently horizontally conveyed onward, from right to left. The products 1, which have not been shown in FIG. 3, will be brought up lying flat and inserted into the compartments 11 formed between compartment walls 12 in a manner similar to that for the arrangement shown in FIG. 1. At the bends, where compartment walls 12 will be more or less spread apart, depending upon the diameters of the respective idler sprockets 19 employed, products might drop down if they have not been made their ways all the way down to the bottoms of compartments during preceding stages. Products may then be ejected, for example, ejected upward or along an axis extending into, or out of, the plane of the drawing, while on the top run. Since products might also extend beyond the edges of compartment walls 12 along an axis extending into, or out of, the plane of the drawing while on the top run, they may be gripped while there in order to eject them for stacking.

Such an arrangement will be of interest whenever reorientations that reorient products coming from items of manufacturing equipment into the desired orientations for further packaging are also to be performed by the system.

The invention claimed is:

1. A stacker comprising:

a transfer device (4) for serially accommodating individual products (1) consecutively conveyed to the transfer device (4) along their long axes, wherein the transfer device (4) has receptacles (5), each of which accommodates an individual product (1) between a pair of sidewalls (6), wherein the sidewalls (6) are carried by a conveyor (7) at an acute angle and travel over an idler (10) that spreads the sidewalls (6) further apart to receive one of the products (1) that is inserted in each of the receptacles (5), and wherein the idler (10) is positioned intermediate two opposite ends of the conveyor (7) to divide the conveyor (7) into two sections with a slight bend around the idler (10) so as to close together the sidewalls (6) shortly after one of the products (1) has been inserted in one of the receptacles (5);

a serializing device for realigning individual products (1) coming from the transfer device (4) that are laid out flat next to one another such that their flat sides will be parallel and face one another; and a row of compartments (11) for the products (1) that may be conveyed along a direction orthogonal to the flat sides of the products (1) being carried by the transfer device (4), wherein each such compartment (11) is configured for accommodating at least one product (1).

2. A stacker according to claim 1, wherein the transfer device (4) is configured such that products (1) are decelerated and brought to a standstill between the serializing device's entrance and exit.

3. A stacker according to claim 1, wherein the transfer device (4) is configured such that it gives products (1) a velocity component along the row of compartments' direction of travel.

4. A stacker according to claim 1, wherein the transfer device (4) has receptacles (5), each of which accommodates a single product (1) , where the receptacles (5) are transported at a constant rate that is less than the rate at which the products (1) are transported.

5. A stacker according to claim 1 4, wherein the receptacles change their shape before, or after, they receive an item (1).

6. A stacker according to claim 4, wherein each receptacle has a pair of sidewalls (6) and every sidewall (6) is common to adjacent receptacles (5).

7. A stacker according to claim 6, wherein the included angle between the pair of sidewalls (6) of a receptacle (5) is increased prior to a product (1) being accommodated in that receptacle (5) and the included angle between its pair of sidewalls (6) is decreased after a product (1) has been accommodated in the receptacle (5).

8. A stacker according to claim 4, wherein the receptacles (5), or their sidewalls (6), are attached to a circulating conveyor (7).

9. A stacker according to claim 8, wherein the circulating conveyor (7) has a bend around the idler (8) for opening and closing the receptacle (5).

10. A stacker according to claim 1, wherein a serializing device has a stop (15) for the leading edges (14) of products (1).

11. A stacker according to claim 10, wherein the stop (15) is configured such that it has fixed location.

12. A stacker according to claim 10, wherein the stop (15) is formed from a component of the compartments (11) of the row of compartments.

13. A stacker according to claim 1, wherein the compartments (11) are formed between pairs of compartment walls (12).

14. A stacker according to claim 1, wherein the compartment (11) that is currently being loaded by the transfer device (4) is opened and subsequently closed.

15. A stacker according to claim 14, wherein the opening of the compartment (11) is effected by tilting the trailing compartment wall (12*a*)

16. A stacker according to claim 1, wherein the compartment (11), or the compartment walls (12), are attached to a circulating conveyor (13).

17. A stacker according to claim 15, wherein the conveyor (13) is deflected in order to tilt the compartment walls (12*a*).

* * * * *